United States Patent [19]

Cahuzac et al.

[11] Patent Number: 4,644,619

[45] Date of Patent: Feb. 24, 1987

[54] METHOD FOR PRODUCING COMPLEX OBJECTS BY MULTIDIRECTIONAL DEPOSITION OF THREAD

[75] Inventors: Georges J. J. Cahuzac, Le Bouscat; François J. R. Monget, Merignac, both of France

[73] Assignee: Societe Nationale Industrielle et Aerospatiale, France

[21] Appl. No.: 819,814

[22] Filed: Jan. 16, 1986

Related U.S. Application Data

[60] Continuation-in-part of Ser. No. 679,297, Dec. 7, 1984, abandoned, which is a division of Ser. No. 519,578, Aug. 2, 1983, abandoned.

[30] Foreign Application Priority Data

Aug. 9, 1982 [FR] France ..... 82 13893

[51] Int. Cl.[4] ..... B32B 7/08; D04H 3/04

[52] U.S. Cl. ..... 28/100; 28/149; 28/289

[58] Field of Search ..... 28/100, 149, 151, 289; 139/11, 34; 19/160; 53/429, 430

[56] References Cited

U.S. PATENT DOCUMENTS

| | | | |
|---|---|---|---|
| 2,065,498 | 12/1936 | Bacheller | 28/151 |
| 2,463,365 | 3/1949 | Epstein | 139/34 |
| 2,563,510 | 8/1951 | Bellin | 139/1 R |
| 2,566,657 | 9/1951 | Epstein | 139/34 |
| 2,726,434 | 12/1955 | Knoblock et al. | 28/149 |
| 2,959,825 | 11/1960 | Gould | 28/149 X |
| 3,739,437 | 6/1973 | Alberici et al. | 28/151 |
| 3,805,345 | 4/1974 | Antos | 28/149 |
| 3,955,602 | 5/1976 | King . | |
| 4,183,232 | 1/1980 | Banos et al. . | |
| 4,218,276 | 8/1980 | King . | |
| 4,393,669 | 7/1983 | Cahuzac . | |

FOREIGN PATENT DOCUMENTS

| | | | |
|---|---|---|---|
| 248928 | 1/1964 | Australia | 28/289 |
| 5552863 | 4/1980 | Japan | 28/289 |

OTHER PUBLICATIONS

Callaway Textile Dictionary, First Edition, 1947, Callaway Mills, LaGrange, Ga., p. 376.

Man Made Fiber and Textile Dictionary, 1975, Celanese Corporation, New York, N.Y., p. 130.

*Primary Examiner*—Robert R. Mackey

*Attorney, Agent, or Firm*—McGlew and Tuttle

[57] ABSTRACT

The invention concerns the production of three-dimensional thread packages. Vertical rods (11) are maintained in a stationary arranged network by engagement through perforated plates (12,13). A thread (10) is deposited from above this network by a shuttle (9) in a sinuous path between upper end portions of the rods (11). The layers of thread thus formed in succession, supported by the perforated plate (12) which undergoes a descending movement, are compacted by a perforated plate (7) which is lowered upon the finishing of each layer. A lacing arrangement (35) replaces the rods (11) by threads after the thread layer phase.

4 Claims, 6 Drawing Figures

FIG. 3
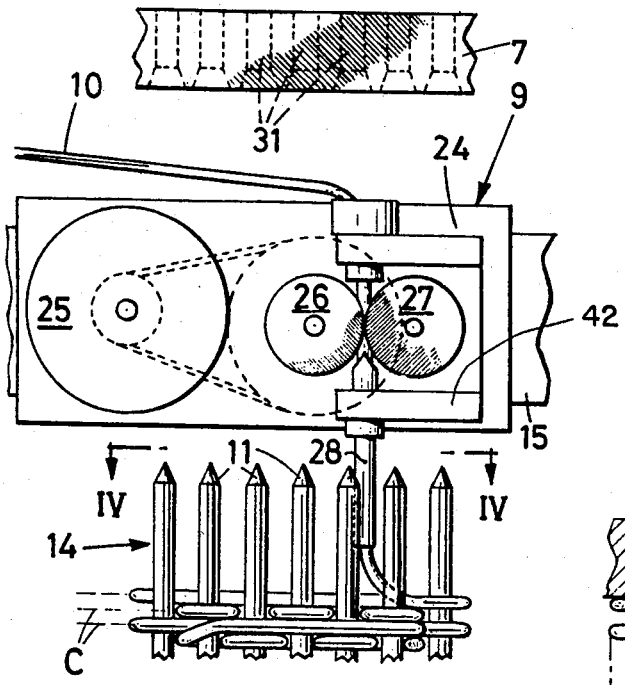
FIG. 5
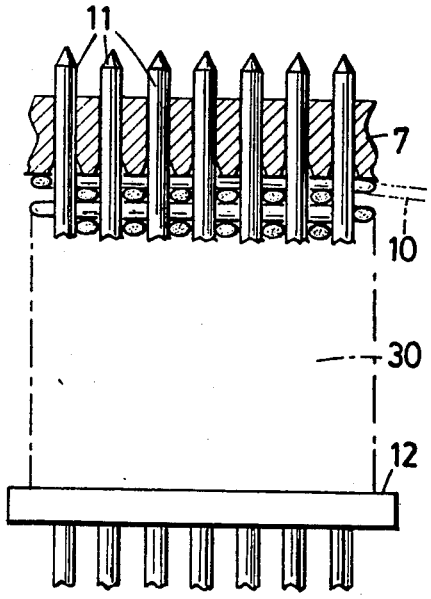
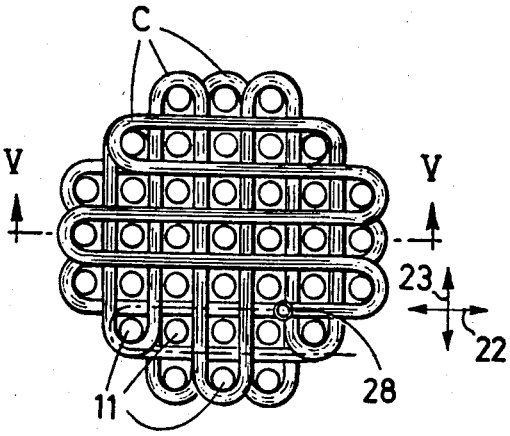
FIG. 4

METHOD FOR PRODUCING COMPLEX OBJECTS BY MULTIDIRECTIONAL DEPOSITION OF THREAD

CROSS REFERENCE TO RELATED APPLICATIONS

This is a continuation-in-part application of the joint inventors' application Ser. No. 679,297 filed Dec. 7, 1984, (now abandoned) which was a divisional application of Ser. No. 519,578 filed Aug. 2, 1983 (now abandoned).

FIELD AND BACKGROUND OF THE INVENTION

This invention concerns a process and a machine for the production of a package made up of threads assembled by multidirectional weaving, i.e. deposit of thread about a network of rods, and susceptible to serve as a framework in the manufacture of a body made of composite material.

Such frameworks are utilized, after impregnation with a suitable binder and subsequent hardening of the binder, for the purpose of obtaining components capable of withstanding very high mechanical and thermal stresses, for example, those used for the structural components of satelites, re-entry bodies, or rotor hubs for rotary winged aircraft.

A manual process is already known from U.S. Pat. No. 4,218,276 (AVCO), for creating three-dimensional structures, consisting of upwardly pointed vertical and parallel needles, held apart by two reeds arranged at right angles. Over the needle points a layer of fabric in then placed, and against it is pressed a plate equipped with holes corresponding to the needles, the points of which penetrate the fabric which is pressed downwardly by the plate. This operation is repeated by rotating the reeds until the required stack thickness is obtained, after which the stack is removed from the machine. Then, filamentary reinforcements are introduced into the holes made in the stack so as to form a three-dimensional structure. In order to put this process into operation, it is therefore necessary to have available layers of fabric manufactured in advance and trimmed to the dimensions required for each specific product. Moreover, while this U.S. patent proposes the creation of so-called three-dimensional structures in which rigid components such as metallic needles are arranged vertically, it can be seen that such structures cannot be obtained by the simultaneous deposit of threads on those needles. Instead, bonded layers are formed first, after which they are stacked up and then penetrated by the needles.

Likewise known, from U.S. Pat. No. 4,183,232, to the present applicant, is a three-dimensional weaving machine for the production of hollow, rotating woven frames. Into a network of rods, held parallel to the generating lines of the body to be created by means of gratings, there are introduced and woven on a fixed plane, on the one hand, circumferential threads by unwinding in concentric circles parallel threads, and on the other, radial threads by knitting by means of a needle, of a thread in the form of a chain. In this process, the rods can be metal pins which, at the end of the weaving, are removed and replaced, through a lacing arrangement, by threads which provide longitudinal filling.

The process known from U.S. Pat. No. 3,955,602 makes it possible to create pieces of simple geometric shape, such as, essentially, parallelepiped blocks in which the threads deposited on a single plane emerge on either side of a network of vertical pins with an overlap, requiring, on this account, the use of a thread locking device. U.S. Pat. Nos. 3,955,602; 4,183,232 and 4,218,276 discussed above are incorporated here by reference.

In general, the processes according to the prior art require specific tooling for the piece to be made to the extent that the weaving is linked to the separation or pitch of the vertical pins. Consequently, they do not permit rapid and economical changes in the woven pieces.

Moreover, most of the known processes for the creation of woven pieces of three dimensions require the installation of a substantial number of thread bobbins, and consequently, the manipulation of same in order to pass from one piece to another.

Finally, the essential problem to be resolved in the weaving of structures of the type considered lies in the fact that the threads to be introduced in a network of pins or rods must be deposited in such a way that no residual tension will be retained in them.

In fact, the accumulated tensions would finally deform the network and prevent continued production, by shutting down the respective machine, for example. This problem is usually resolved, either empirically, through the skill of the operator, or by the use of pin-holding equipment with introduction of the threads under tension and threading each thread into a needle.

SUMMARY OF THE INVENTION

The present invention makes it possible to remedy the disadvantages of the processes and equipment of the prior art. Its objective is a process which consists, in an initial phase of production, of creating a network of rigid rods, parallel but not joined together, of depositing at one end of said stationary network a single thread following a twisting route zigzagging between the terminal portions of the rods, with the thread forming successive layers superimposed on each other on planes transverse to the direction of the rods, of compressing these layers of thread as they are formed, this compression being accompanied by a sliding of said layers along the rods, and if necessary, of the subsequent replacement of the rods by means of threads in a final lacing phase.

The compression with sliding of the layers of thread along rods is accomplished preferably by the intermittent application of pressure on each new layer completed, the overall assembly of superimposed layers being held at its base by a supporting surface which moves away in a continuous motion from the thread-deposit area in order to make room for the new layers of thread to be deposited.

it is desirable that the thread be deposited without tension in the network of rods, and to this purpose it is delivered by mechanical thrust, on demand, in a direction generally parallel to the direction of the rods.

The thread can be deposited in windings oriented in the layers, superimposed alternately, first in one direction and then in another, crossing the first, for example, perpendicular to it (in this case, these two directions form a trirectangular trihedron with the direction of the rods).

Thus, the process according to the invention makes it possible to perform the weaving in three dimensions of shaped pieces of complex design and any dimensions, by the deposit in the free spaces of the rods which define one direction of the piece to be produced, and with a thread following any direction at right angles to the preceding one, This thread comes from a single bobbin and it is reeled mechanically from above the rods (which are assumed to be arranged vertically), at the level of the top of the rods and parallel to their long direction. When a layer of thread is deposited, it is compressed at the same time that the component intended to hold the piece during the course of production is shifted in order to permit the deposit of the next layer. When the directions perpendicular to the rods have been materialized by the thread according to this method of thread deposition or weaving, these rods are removed in the course of a terminal operation called lacing, and they are replaced by a thread, preferably according to the process described in U.S. Pat. No. 4,393,669, to the present application. U.S. Pat. No. 4,393,669 is also incorporated here by reference.

Likewise, rods formed from a material remaining in the piece can also be used, examples of these being pulp-extruded rods, and therefore, in this case, it is evident that the lacing operation is not applicable. In this case the rods remain as part of the thread package.

By virtue of this process, it is possible to change at will, in each layer, the direction of the thread deposited at the top of the rods, in accordance with the stresses to which the woven piece or package is likely to be subjected. This is not the case in the known processes, in which, in general, the precise direction of the thread is dictated by the methods of operation of the process used.

In addition, the process according to the invention, makes it possible to eliminate any system for stopping the threads introduced perpendicularly into the network of rods, and this leads, therefore, to the construction of a very simple machine.

Finally, the arrangement provides for a single bobbin which facilitates monitoring of the reeling out of the thread. In the prior art, it is generally necessary to provide several bobbins in order to feed the needles which make it possible to introduce the threads into a given layer, these bobbins being equipped with devices for reeling the thread and for applying tension, and even for braking movement of the thread, in order to cause a given quantity of thread to arrive at each one of the bobbins for the creation of a layer, and without tension, so as not to deform the network of rigid pins or rods. The process according to the invention makes it possible to avoid these requirements.

The invention also concerns a machine which makes it possible to use the previously-described process. This machine comprises, arranged on top of each other in a stationary housing, an assembly of three horizontal frames, which do not rotate but are independently movable vertically, among which, the intermediate frame has a set of horizontal plates provided with orderly perforations of regular design and intended to receive rigid rods of equal length which are thus held in a regular vertical network. The upper frame is equipped, by means of a displacement mechanism in accordance with two horizontal crossing directions, which are preferably perpendicular, with a shuttle which is thus movable in any direction on a horizontal plane, located slightly above the top of the network or rods, and capable of depositing on the top of same a thread which follows a winding path. The lower frame is equipped with a horizontal stopping plate, not perforated, subjacent to the network of rods. It is understood that the machine just described will meet the requirements if the rods are made from material remaining in the piece, such as paste-extruded materials, for example. In this case, the initial operation of weaving of thread deposition is the only operation necessary in order to obtain a three-dimensional weave. This same machine will likewise meet the requirements in cases in which—after the weaving has been performed on rods which are to be replaced by threads—it might be desired, for reasons of convenience of production, for example, to carry out the final operation of lacing at a different work station. But it might be useful for the same machine to perform the final phase of lacing, as well. In this case, it is advisable that the machine be equipped with a lacing device, in addition in order to make it possible to replace the rods with threads, after the initial thread deposition of weaving is completed. This lacing accessory consists, preferably, of an upper device to actuate a lacing needle, and a lower device for introduction of the lacing thread, these devices being installed in the respective mechanism of displacement in two crossing horizontal directions, mounted, respectively, on the upper frame and on the intermediate frame.

Advantageously, the machine's shuttle includes means for pulling and pushing the thread, capable of ensuring the delivery of the thread without tension, and consisting of two rollers between which the thread is held, and one of which is put into rotation by a motor. These rollers, push the thread, after it is deposited, into a vertical thread-guide.

In addition, the machine is preferably equipped with a perforated horizontal plate, capable of descending over the network or rods, so that the rod ends then penetrate these perforations, thus compressing the layers of woven thread in said network. This perforated plate can be installed on the upper frame, above the shuttle, which is moved away from the rods from time to time in order to permit said perforated plate to descend onto the layers of deposited thread.

Below the network of rods, the stopping plate can consist of a disk driven in rotation around its vertical axle, and comprising a vibrating bar which ensures, by sweeping under all the rods in turn, the longitudinal position of the rods at a constant average height, despite the frictional downward pull they are subjected to by the thread package in the course of production.

It is desirable to combine with the machine according to the invention, a numerical control device to pilot and synchronize, according to a pre-established program, all of the operations of its movable parts, especially those of its shuttle, which define the configuration of the winding paths for deposit of the thread which form the successive layers of the package.

BRIEF DESCRIPTION OF THE DRAWINGS

The description which follows, with reference to the attached drawings by way of example and without limitation thereto, makes it possible to understand clearly how this invention can be put into practice.

FIG. 3 shows, on a larger scale, detail III of FIG. 1;

FIG. 4 is a sectional view taken along line IV—IV of FIG. 3; FIG. 5 shows schematically a sectional view taken along line V—V of FIG. 4, showing at the same time the lower perforated plate which supports the thread package in the course of production, and the upper perforated plate, lowered in position in order to compress the package.

DESCRIPTION OF THE PREFERRED EMBODIMENT

Figure 1:
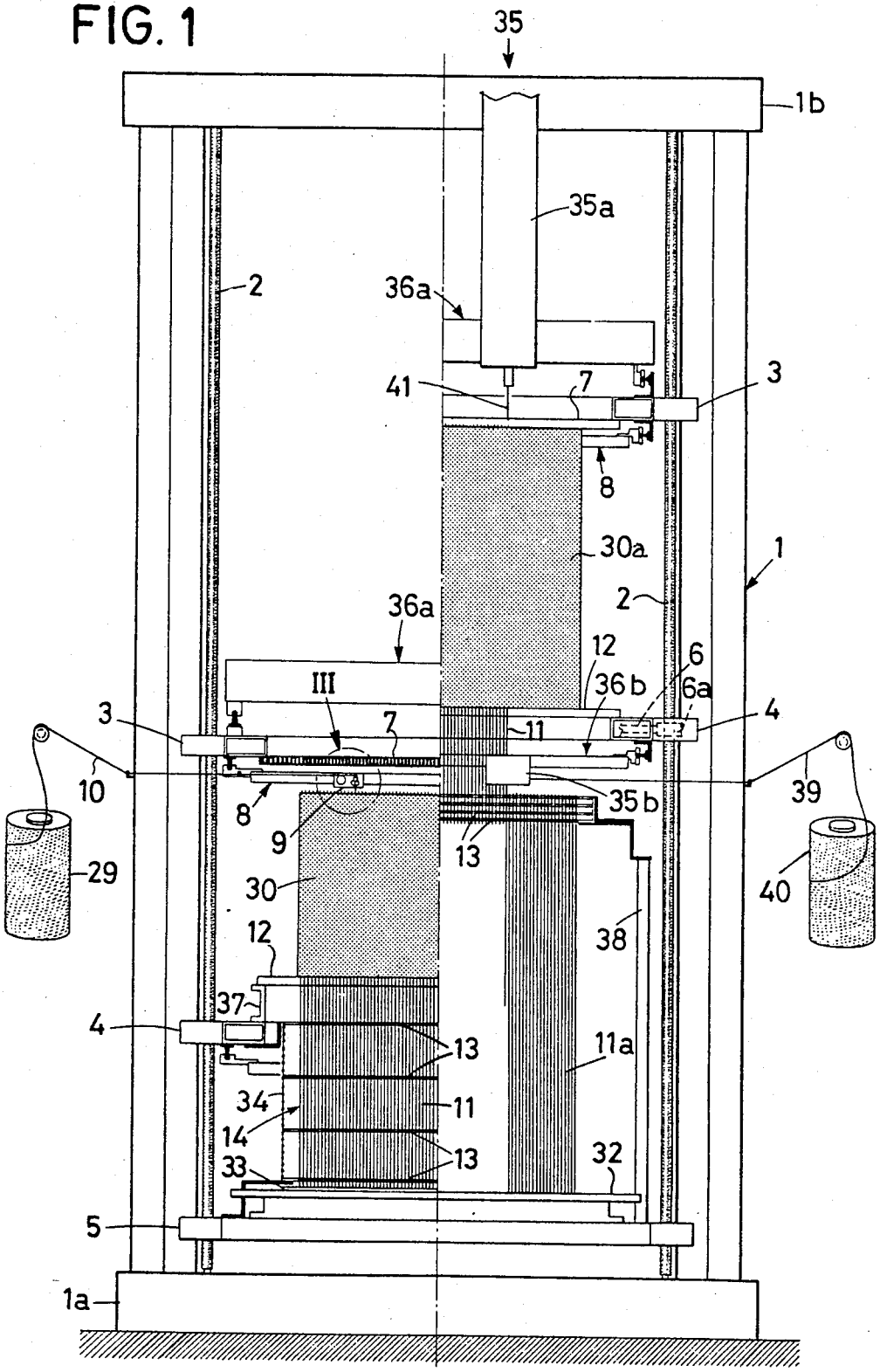
FIG. 1 represents, schematically, in vertical section, a multidimensional thread depositing machine according to the invention, the left side showing the thread depositing phase and the right side showing the lacing phase.

In the drawings, no importance should be attributed to the fact that the number of rods of the network varies from one figure to the other. It is done this way for the simple reason of convenience of representation and understanding. In practice, the number and the arrangement of the rods are selected in accordance with the conformation and dimensions of each thread package to be produced.

The machine represented in FIG. 1 comprises a housing 1, in which are installed, between its base 1a and its roof **1*b*, several stationary vertical threaded pins 2 (at least three), along which three horizontal frames,-3,4, and 5 can move. To this end, each one of these frames is provided with its own motor (not shown) in order to drive in rotation, by means of a chain 6, nuts engaged on the aforesaid threaded pins (only one of these nuts 6*a* of the single frame 4 has been shown, with the corresponding portion of chain 6**). Each frame can thus be moved, at will, either upwardly or downwardly under the control of that motor.

In other words, each frame 3, 4 and 5 has its own chain 6 which is movable by a motor. Each frame 3, 4 and 5 also has its own set of nuts **6*a*, each threaded onto one of the threaded rods 2, and each rotatable by movement of the chain 6. When the motor is driven to move the chain, each of the nuts 6*a*** of the respective frame rotates to raise or lower that frame. Since the chain for each plate is rotatable independently of the chain for any other plate, the frames are movable independently of each other.

The upper frame 3 is equipped with a perforated plate 7, and by means of a displacement mechanism 8 providing crossing movement, a shuttle 9 which performs the deposit of a thread 10 in a network 14 of rigid metal rods 11, held vertically in a regular distribution by perforated plate 12 and 13 (the number of plates 13 depends on the height of the piece to be produced), carried by intermediate frame 4. The perforations of plates 7, 12 and 13 are arranged according to gridlines (straight, as shown in this illustration, or oblique), in such a way that rods 11 of network 14 which crosses them causes the appearance among them of channels which cross each other at a certain angle, in this case a right angle, into which the thread 10 is deposited by shuttle 9, according to alternating perpendicular changes of direction. The lower most perforated plate 13 is attached to lower frame 5 by means of clamps 51.

Figure 2:
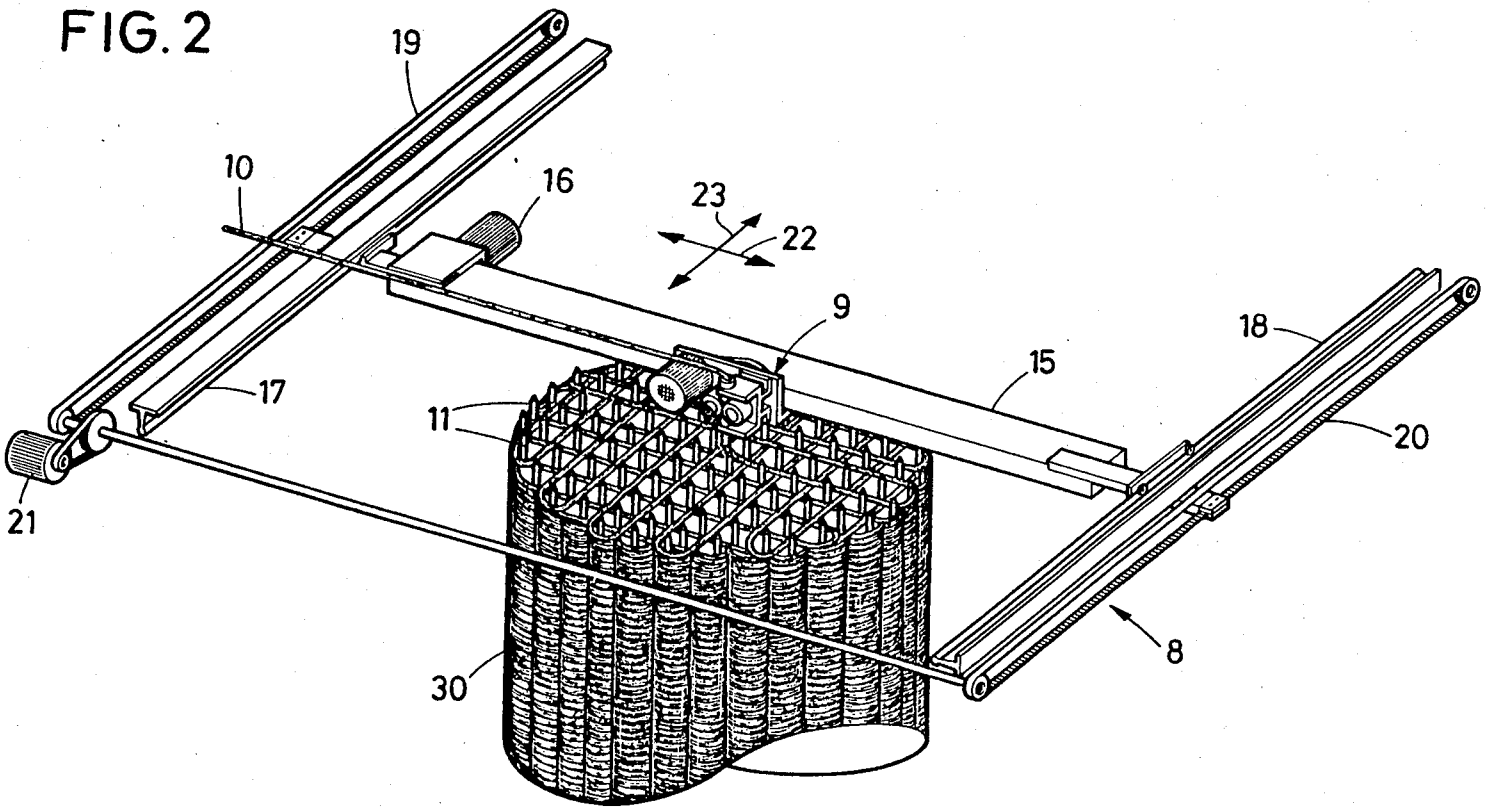
FIG. 2 represents, in perspective, a top view of the network of rods and of the thread package being produced therein, in addition to the shuttle and its displacement mechanism.

Mechanism 8 which causes the displacements of shuttle 9 comprises a horizontal guide bar 15, along which the shuttle can move, actuated by a motor 16 through the medium of a transmission belt located inside the guide bar 15 (FIG. 2). The guide bar 15 is itself movable in a perpendicular horizontal direction, and its ends roll along guide rails 17,18 atached to upper frame 3, under the action of transmission belts 19,20 driven by a motor 21, likewise secured to frame 3. Shuttle 9 can thus move in two perpendicular horizontal directions 22 and 23, and therefore it can be moved successively to any point on the horizontal plane limited by rails 17,18.

Shuttle 9 (FIG. 3) consists of a carriage 24, which slides along guide bar 15 and is equipped with a small step motor 25 and two rollers 26 and 27 between which the thread 10 is clamped. Roller 26 is driven in rotation by motor 25, while roller 27 is mounted for idle rotation. By command of motor 25, thread 10 is pushed more or less rapidly into vertical thread-guide tube 28, attached to plate 42 of carriage 24, and passing between the upper ends of rods 11 on the network 14, in order to deposit the thread on top of the network in accordance with the winding path selected.

In order to make a thread package of specific shape on the machine described, rods 11 are first of all engaged through perforated plates 12,13 in order to arrange them in a regular network 14 offering the shape desired (in this case, it is a cylindrical shape of circular or polygonal section). Since frame 3 is placed at such a height that the thread-guide tube 28 of shuttle 9 will penetrate into the upper part of network 14 (FIG. 3), the shuttle is moved by its mechanism 8 along a winding course the turns of which are oriented in accordance with one of the directions of the orthogonal channels of network 14, parallel to the directions of displacement 22,23 of shuttle 9. At the same time, the shuttle's motor 25 is put in operation, so that thread 10, coming out of bobbin 29, is deposited on the top of the network or rods in accordance with that winding path between the upper ends of the latter (FIG. 4). Deposit of the thread without tension is accomplished by means of a speed of output of the thread from the shuttle, synchronized with the speed of displacement of said shuttle.

When a layer C of thread has been deposited, the next layer C is deposited in superimposition on top of it, in accordance with the other direction 22 or 23. Upon the completion of each layer, shuttle 9 is caused to move to one side, and the downward displacement of frame 3 is ordered so as to cause the perforated plate 7 (FIG. 5) to come down onto network 14, for the purposes of compressing the mass 30 made up of all of the layers C produced. In order to ensure eady penetration of rods 11 into the perforations 31 of plate 7, the ends of the rods are ground to a point and the perforation openings are flared, as shown. In a parallel manner, frame 4 is caused to descend from a distance approximately equal to the thickness of one layer, so that mass 30 will descend gradually, held by perforated plate 12 attached to frame 4 and compressed be perforated plate 7, attached to frame 3. After each operation of compression, in which perforated plate 7 always descends to the same level, it is caused to rise again (by the upward movement of frame 3), up to a likewise fixed level, sufficient to make room for shuttle 9 between said perforated plate and the ends of rods 11, so it can return to the space in order to effect the deposit of a new layer of thread after having reabsorbed the space required by its movement to one side prior to the compression.

It will be recalled that the frames 3 and 4 each have their own drive chain 6 and threaded nuts **6*a* for effecting upward and downward movement of each frame. It should also be understood that the rods 11 can slide with respect to the perforated plates 12,13. This sliding, however, is impended by the fact that the rods have thread 10 wrapped around them. Friction between the rods and the threads tend to make the rods move along with the woven mass 30. A relative movement between the rods and the woven mass 30 is effected using a mechanism connected to the lower frame 5 as will be discussed below. It should also be remembered that the left hand side of FIG. 1 shows the mechanism during a weaving stage when the woven mass 30** is being formed while the right half shows a lacing stage.

Figure 6:
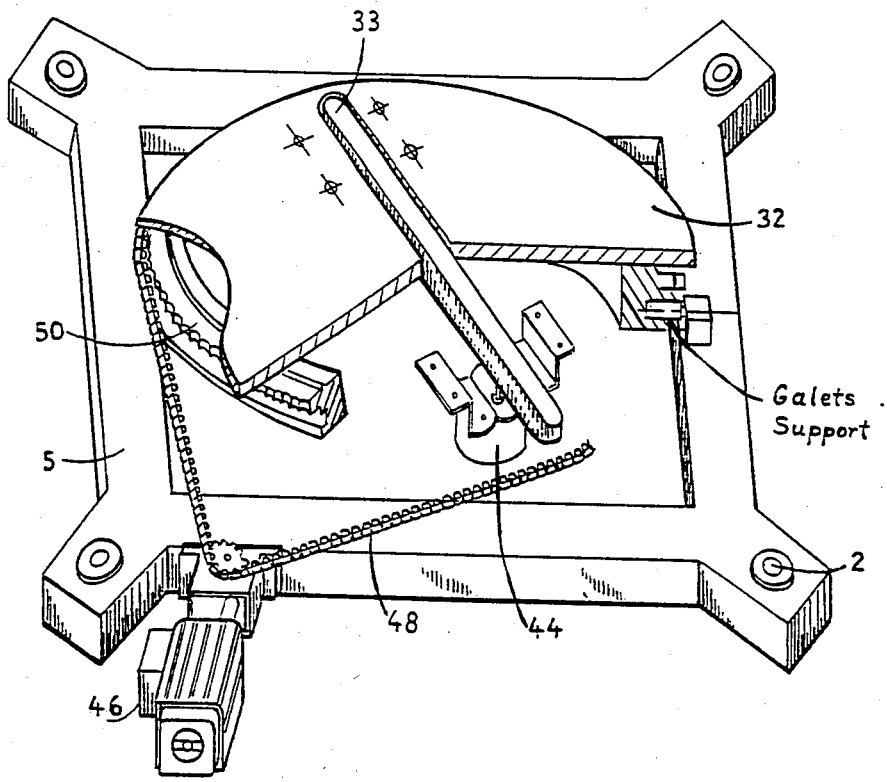
FIG. 6 shows schematically and in exploded perspective, the lower part of the machine, and more particularly the vibrating device used in the thread depositing phase.

The rods are linked by friction of the mass 30 as noted above, and they are therefore pulled downward at the time of the descent of frame 4. In order to compensate for this effect, under the network of rods there is provided and carried by frame 5 (of adjustable height), a disc 32, driven in rotation under the effect of a motor gear reducer 46, through the medium of a chain 48 and a toothed gear 50, equipped with a vibrating bar 33 (FIG. 6), seated in the disc 32 by a pair of vertical-action vibrators 44 (one shown) which are connected under disc 32. The rotation of the rotating assembly 32, 33 and 44, allows bar 33 to sweep under all the rods in the set of rods which it strikes successively and causes them to rise, thus cancelling the descent caused by the descent of frame 4. Therefore, rods 11 retain a constant overlap with respect to the last layer deposited, thus permitting the deposit of the next layer under the the same conditions as the preceding layer. At the end of the thread laying operation, frame 4 is located near frame 5, and perforated plates 13, suspended by chains 34 attached to frame 4, have consequently become juxtaposed.

The mass 30 is then completed and can be transferred, as applicable, either to a binder impregnation station, or to another machine or work station in order to carry out the terminal phase of lacing (if used). But the machine covered by the invention can also carry out this terminal phase in order to produce the three-dimensional mass 30*a*. To this end, the machine is equipped with a lacing accessory 35 (already described in the applicant's U.S. Pat. No. 4,393,669 incorporated here by reference) consisting of an upper device 35*a* (FIGS. 2 and 3 of U.S. Pat. No. 4,393,669) and an upper device 35*b* (FIG. 7 of the same patent). These devices are shown together in the right-hand portion of FIG. 1 of the present application. The upper device 35*a* is installed on frame 3 through the medium of a displacement mechanism 36*a* providing for two orthogonal directions, similar to mechanism 8 of shuttle 9. The same is true for lower device 35*b*, the displacement mechanism 36*b* of which is mounted on frame 4. These lacing assemblies are removable.

In the lacing phase, frame 4 which carries the woven piece by means of its perforated plate 12 (the lift called for in the weaving phase having been eliminated) is raised to a height to allow a sufficient space below for the descent of rods 11*a*, displaced by woven mass 30. The frame is lifted correspondingly to a position in which its perforated plate 7 rests on the top of woven mass 30. According to the assertions of the already cited U.S. Pat. No. 4,393,669, the upper device 35*a* causes a long needle 41 to descent successively plumb with each rod 11, so as to remove it and cause it to fall to 11*a* under frame 4, onto disc 32 (while it remains held by perforated plates 13, now reassembled and held at the top of columns 38). At each descent, the aforesaid needle threads lower into device 35*b* a thread 39 coming from a bobbin 40 and pulls it in a loop through woven mass 30 in replacement of the rod it has just forced out, thus transforming mass 30 into a three-dimensional mass 30*a*. Naturally, the displacement mechanism 36*a* and 36*b* are controlled correspondingly in the same way so that the lacing devices 35*a* and 35*b* will constantly be opposite each other and will successively be plumb with each rod of network 14.

Control of the various movable components of the machine, especially displacement mechanisms 8, 36*a* and 36*b* (equipped with step motors), is effected in synchronization, in each phase of operation, by means of a numerical control device of a classic programmable type well known to technicians and not forming a part of the present invention, into which there is introduced a program corresponding to the characteristics of structure, shape and dimensions of the thread package or woven piece to be produced.

It is understood that, through the choice of this program, it is possible to obtain the deposit of the thread by shuttle 9 in each layer, in accordance with any desired winding path among rods 11 of the network.

Moreover, these rods can be arranged in a transverse section of any shape and geometric disposition. It is also possible to obtain pieces of any shape, solid or hollow, or even deformable if the path for deposit of the thread is selected to that end in each transverse layer.

This numerical control is a standard numerical control designed to control milling machines and capable of operating three shafts simultaneously, and of controlling the output (all or nothing) which might be required in the program for production of the package. Such a control is commercially available for milling machines and can be used for the present invention.

The lower frame is movable only by manual control of the operator accomplished by pressing a respective button (not shown) on the numerical control unit.

All of the functions involved in the deposit of the thread, i.e.,:

- rotation of the plate 32 which supports the vibrating bar 33, and start-up of the vibrator;
- descent of the intermediate frame 4 by the thickness of one layer;
- descent of the upper frame 3 in order to compress the layers of thread deposited;
- lifting up of the upper frame 3; and
- simultaneous rotation of the three step motors, i.e., the two shuttle displacement motors and the motor which thrusts the thread;

are the result of instructions from the program which defines a thread package and the re-entry into numerical control.

While a specific embodiment of the invention has been shown and described in detail to illustrate the application of the principles of the invention, it will be understood that the invention may be embodied otherwise without departing from such principles.

We claim:

1. A method for producing a package for use as a framework in the manufacturing of a body of composite material and which is formed by threads assembled by a multi-directional deposit of thread, said method comprising:

depositing a single thread without residual tension in a sinuous path extending in a first direction and zig-zagging between end portions of rigid mutually parallel rods as to form a layer of said thread in a plane transverse to the direction of said rods;

supporting the layer on a bearing surface;

moving the bearing surface away from the region in which the thread is being deposited by about the thickness of the layer;

compacting the layer along the rods with sliding of the layer by applying a pressure to the layer;

depositing the single thread without residual tension in a sinuous path extending in a second direction and zig-zagging between end portions of the rigid mutually parallel rods so as to form a subsequent layer of said thread in a plane transverse to the direction of said rods, said second direction crossing said first direction so that said first-mentioned layer crosses said subsequent layer;

supporting the subsequent and first-mentioned layers on the bearing surface;

again moving the bearing surface away from the region in which the thread is being deposited by about the thickness of the subsequent layer;

compacting the subsequent layer along the rods with sliding of the subsequent layer by applying a pressure to the subsequent layer; and repeating the steps of depositing, supporting, moving and compacting to form additional superimposed layers alternating in the first and second direction until a desired number of layers is formed.

2. A method according to claim 1, wherein the thread deposited without tension between said rigid mutually parallel rods is delivered by a mechanical thrust on demand in a direction substantially parallel to said direction of the rods.

3. A method according to claim 1, including carrying ends of said rigid mutually parallel rods which are opposite from said end portions thereof between which said thread is deposited for counteracting a force on said rods transmitted to said rods by said steps of compacting and through friction between said layers and said rods.

4. A method according to claim 3, including vibrating said carrying of said rods after each step of compacting for sliding said rods with respect to said layers.

* * * * *